US005417504A

United States Patent [19]

Andrews et al.

[11] Patent Number: 5,417,504

[45] Date of Patent: May 23, 1995

[54] REFILL UNIT FOR A WRITING INSTRUMENT

[75] Inventors: Neville E. Andrews, West Sussex; Brian A. J. Booker, East Sussex, both of United Kingdom

[73] Assignee: Parker Pen (I.P.) Limited, United Kingdom

[21] Appl. No.: 157,009

[22] PCT Filed: Jun. 3, 1992

[86] PCT No.: PCT/EP92/01230

§ 371 Date: Nov. 30, 1993

§ 102(e) Date: Nov. 30, 1993

[87] PCT Pub. No.: WO92/22433

PCT Pub. Date: Dec. 23, 1992

[30] Foreign Application Priority Data

Jun. 14, 1991 [GB] United Kingdom ..... 9113220

[51] Int. Cl.[6] ..... B43K 24/08; B43K 24/06

[52] U.S. Cl. ..... 401/110; 401/111

[58] Field of Search ..... 401/109, 110, 111

[56] References Cited

U.S. PATENT DOCUMENTS

| | | | |
|---|---|---|---|
| 4,991,988 | 2/1991 | Snell et al. | 401/109 X |
| 5,184,908 | 2/1993 | Yamamoto et al. | 401/109 X |

FOREIGN PATENT DOCUMENTS

| | | | |
|---|---|---|---|
| 253464 | 5/1963 | Australia . | |
| 199539 | 2/1958 | Austria | 401/111 |
| 252694 | 1/1988 | European Pat. Off. . | |
| 1167442 | 11/1958 | France . | |
| 2040970 | 2/1972 | Germany | 401/110 |
| 748897 | 5/1956 | United Kingdom . | |
| 945281 | 12/1963 | United Kingdom | 401/111 |
| 956960 | 4/1964 | United Kingdom | 401/111 |
| 1007198 | 10/1965 | United Kingdom | 401/111 |

*Primary Examiner*—Steven A. Bratlie

*Attorney, Agent, or Firm*—Andrus, Sceales, Starke & Sawall

[57] ABSTRACT

A refill unit (1) for a writing instrument has a writing tip (5) at one end and a ratchet mechanism (7) at the other end through the use of which the unit (1) can be turned and selectively extended from and retracted into the writing instrument. The ratchet mechanism (7) is rotatable about the longitudinal axis of the unit with respect to the writing tip (5). Each time the refill unit (1) is extended from or retracted into the writing instrument, the tip (5) rotates by a substantially random amount which ensures a more even distribution of wear on the writing tip (5).

8 Claims, 2 Drawing Sheets

REFILL UNIT FOR A WRITING INSTRUMENT

The present invention relates to a refill unit for a writing instrument.

writing instruments, and ball point pens in particular, often incorporate a refill unit. Such a refill unit has a writing tip at one end and paired major and minor ratchet recesses at the opposite end. A pair of fingers provided internally of the writing instrument alternately engage the major and minor recesses of the ratchet on depression of a button on the writing instrument to cause the tip of the refill unit to retract into and extend from the casing of the writing instrument in turn, the action additionally being controlled by a coiled compression spring. Such a ratchet mechanism is shown and described in EP-A-0252694. Each depression, and release, of the button causes the refill unit to rotate by 90° within the casing of the writing instrument. Thus, as users tend always to hold the writing instrument in the same orientation when writing, only two opposite sides of the writing tip of the refill unit are used to write with. This leads to uneven wear of the writing tip which, especially towards the end of the life of the refill, can result in uneven transfer of ink to the paper.

According to the present invention, there is provided a refill unit for a writing instrument, the unit having a writing tip at one end and a ratchet mechanism at the other end by means of which the unit can be turned and selectively extended from and retracted into the writing instrument, the ratchet mechanism being rotatable about the longitudinal axis of the unit with respect to the writing tip.

By this means, each time the refill unit is extended from or retracted into the writing instrument, the tip rotates by a substantially random amount which ensures a more even distribution of wear on the writing tip. It should be noted that the refill unit cannot rotate whilst writing since the unit is held, as conventionally, by a coiled compression spring.

Additionally, it has been found that the invention produces a "click" of lower pitch than that produced by conventional refill units when the refill unit is extended or retracted, the overall sound being less "tinny" and therefore more appealing to the majority of users.

Preferably, the rotating portion is constituted by a sleeve which carries recessed cam surfaces of the ratchet mechanism and which is retained for rotation on a post upstanding from the end of the refill unit remote from the writing tip.

An example of the present invention will now be described with reference to the accompanying drawings in which.

Figure 1:
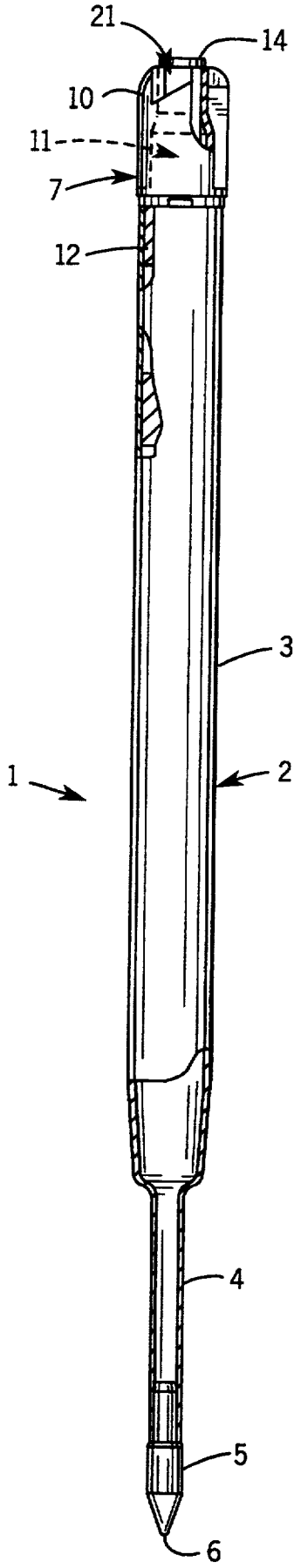
FIG. 1 is a partially sectioned elevation of a refill unit.
Figure 3:
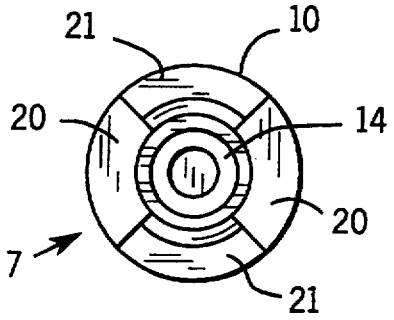
FIG. 3 is a view from one end of the ratchet.
Figure 2:
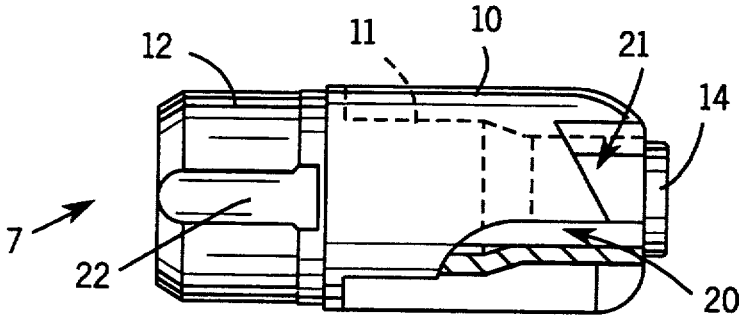
FIG. 2 is a partially sectioned view of a ratchet.
Figure 4:
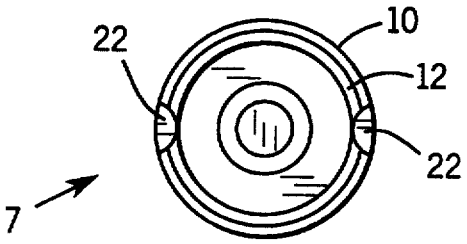
FIG. 4 is a view from the other end of the ratchet.
Figure 5:
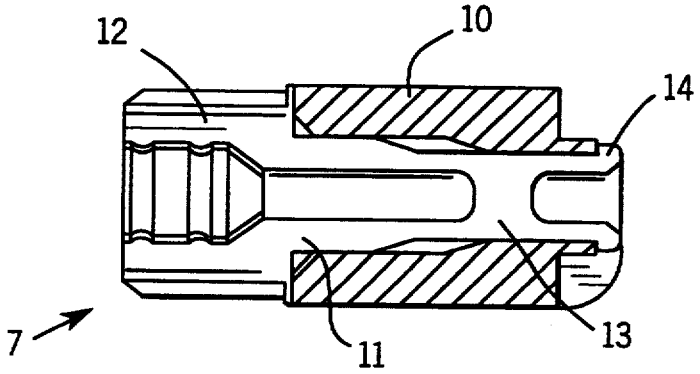
FIG. 5 is a cross-sectional view of the ratchet.

In FIG. 1 there is shown a refill unit 1 for a ball point pen, which has a casing 2 divided generally into a body portion 3 and a shank portion 4 of reduced diameter. The shank 4 carries a conventional writing tip 5 in which is mounted a ball 6.

A ratchet head 7 is fixed in the other end of the body portion 3. The ratchet head 7 is a two part assembly and consists generally of a sleeve 10 and a mount 11. The mount 11 comprises a plug portion 12 which is held within the open end of the body 3 of the refill unit and spigot 13 of reduced diameter which extends away from the plug 12 in a direction opposite the writing tip 5. The spigot 13 has a flare 14 at its outermost end and the sleeve 10 is held for rotation about the spigot 13 between the plug 12 and the flare 14, after having been inserted on the spigot.

The sleeve 10 is provided with conventional major and minor ratchet recesses 20,21. The operation of this aspect of the ratchet, whereby the writing tip is extended when the fingers provided internally of the casing of the writing instrument project into the minor recesses 21 and the writing tip is retracted when the fingers project into the major recesses 20, is completely conventional and well understood by persons skilled in the art and is described in EP-A-0252694. It will not therefore be further described.

The plug portion 12 has a pair of indentations 22 which provide for air ventilation to the body portion 3.

When the refill unit is installed in a ball point pen, with a coil spring disposed around its shank at the tip of the pen, and the button on the pen is operated, the sleeve 10 is rotated by 90° which, by virtue of the fingers riding over the sloped cam surfaces of the major or minor recesses 20,21, causes the writing tip 5 to be extended or retracted as the case may be against the bias of the spring. As the sleeve 10 rotates, it presses down onto the plug portion 12 and, by virtue of the friction generated between the sleeve 10 and the plug 12 by the spring, carries the whole unit 1. As the button is released, this friction is reduced as the refill moves away from the tip of the pen and the plug 12, and therefore the body 2 of the refill unit 1, can rotate with respect to the pen casing; in fact, there is a tendency for the body 2 to "hop", at least partly due to spring pressure and the final resting position of the body 2 with respect to the pen casing is randomly determined. Empirically, it has been found that on average ten operations of the button are required to turn the writing tip through 360°. However, the angular displacement of the writing tip 5 about the longitudinal axis of the refill unit 1 on each operation is a random distribution. Thus, a different part of the writing tip 5 is presented to the paper each time the user extends the writing tip, leading to a more even distribution of wear, thus retaining uniform writing characteristics throughout the lifetime of the refill.

Having a separate sleeve 10 and mount 11 means that colour coding can be achieved in a manner which allows the user to identify quickly and easily the colour of the ink within the refill unit, whilst at the same time allowing a uniformity of appearance across the range of colours provided. For example, the sleeve 10 can be a standard colour, perhaps matching the colour of the casing 2, whilst the mount 11 may be of the same colour as the ink.

As can be seen from FIG. 1, the shank 4 of the refill unit has a constant diameter throughout its length. Conventionally, a step has been formed in this shank. However, it has been found that using a constant diameter shank 4 prevents hang-up of the refill unit 1 on the spring provided within ball point pens. This in itself is an distinct improvement over conventional refill units.

We claim:

1. A refill unit (1) for a writing instrument, the unit having a writing tip (5) at one end and a ratchet mechanism (7) at the other end by means of which the refill unit (1) can be turned and selectively extended from and retracted into the writing instrument, said refill unit having a longitudinal axis extending from said writing tip to said ratchet mechanism, the ratchet mechanism (7) being mounted on said unit, said ratchet mechanism being retained on said unit and being rotatable with respect to the writing tip (5) about the longitudinal axis of the unit.

2. A refill unit according to claim 1, wherein said ratchet mechanism comprises a sleeve (10) which carries recessed cam surfaces (20,21) and which is retained for rotation on a post (13) upstanding from said other end of the refill unit (1).

3. A refill unit according to claim 2, wherein said refill unit has a casing (2) and wherein the post is formed on a plug portion (12) of the ratchet mechanism (7), the plug portion (12) being fitted in said casing.

4. A refill unit according to claim 1 wherein the refill unit (1) has a cylindrical shank portion (4) carrying the writing tip (5), the shank portion having a constant diameter throughout its length along said longitudinal axis.

5. A refill unit according to claim 2, wherein the refill unit (1) has a cylindrical shank portion (4) carrying the writing tip (5), the shank portion having a constant diameter throughout its length along said longitudinal axis.

6. A refill unit according to claim 3, wherein the refill unit (1) has a cylindrical shank portion (4) carrying the writing tip (5), the shank portion having a constant diameter throughout its length along said longitudinal axis.

7. A refill unit according to claim 1 wherein said refill unit and said ratchet mechanism are engageable to transmit a turning force applied to said ratchet mechanism to said writing tip.

8. A refill unit according to claim 7 wherein said refill unit and said ratchet mechanism have surfaces that are brought into abutment and frictionally engage to transmit the turning force.

* * * * *